US010638230B2

(12) United States Patent
Väisänen

(10) Patent No.: US 10,638,230 B2
(45) Date of Patent: Apr. 28, 2020

(54) DIAPHRAGM ASSEMBLY, TRANSDUCER AND METHOD OF MANUFACTURE

(71) Applicant: Genelec Oy, Iisalmi (FI)

(72) Inventor: Jussi Väisänen, Iisalmi (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 15/969,578

(22) Filed: May 2, 2018

(65) Prior Publication Data

US 2018/0324527 A1 Nov. 8, 2018

(30) Foreign Application Priority Data

May 3, 2017 (FI) ..... 20175387

(51) Int. Cl.

| | |
|---|---|
| ***H04R 7/12*** | (2006.01) |
| ***H04R 7/16*** | (2006.01) |
| ***H04R 31/00*** | (2006.01) |
| ***H04R 9/04*** | (2006.01) |

(52) U.S. Cl.

CPC ..... *H04R 7/127* (2013.01); *H04R 7/122* (2013.01); *H04R 7/16* (2013.01); *H04R 31/003* (2013.01); *H04R 9/04* (2013.01); *H04R 2207/021* (2013.01); *H04R 2231/003* (2013.01); *H04R 2307/204* (2013.01)

(58) Field of Classification Search

CPC ..... H04R 7/127; H04R 7/16; H04R 31/003; H04R 2231/003; H04R 7/122; H04R 2307/204

USPC ..... 381/150, 401, 400, 398, 402, 404, 432, 381/361, 386

See application file for complete search history.

(56) References Cited

U.S. PATENT DOCUMENTS

| | | | |
|---|---|---|---|
| 2,269,284 | A | 1/1942 | Olson |
| 3,111,187 | A | 11/1963 | Barlow |
| 4,320,264 | A | 3/1982 | Visan et al. |
| 4,324,312 | A | 4/1982 | Durbin |
| 4,497,981 | A | 2/1985 | House |
| 4,554,414 | A | 11/1985 | House |

(Continued)

FOREIGN PATENT DOCUMENTS

| | | | |
|---|---|---|---|
| EP | 1185139 | A2 | 3/2002 |
| GB | 451178 | A | 7/1936 |

(Continued)

OTHER PUBLICATIONS

European Patent Office; European Search Report and Annex issued in application EP 18 16 0921; dated Sep. 3, 2018; 2 pages; European Patent Office; Munich, Germany.

(Continued)

*Primary Examiner* — Thjuan K Addy

(74) *Attorney, Agent, or Firm* — Chernoff, Vilhauer, McClung & Stenzel, LLP

(57) ABSTRACT

A novel diaphragm assembly, transducer and manufacturing method is here in proposed making use of a diaphragm assembly including a diaphragm having a first diaphragm component and a second diaphragm component. Both diaphragm components extend between respective inner perimeter and outer rim. The outer rim of the first diaphragm component overlaps with and is attached to the second diaphragm component at an overlap section. A voice coil assembly is connected to the inner perimeter of the second diaphragm component.

23 Claims, 2 Drawing Sheets

(56) References Cited

U.S. PATENT DOCUMENTS

| | | | | |
|---|---|---|---|---|
| 5,548,657 | A * | 8/1996 | Fincham | H04R 1/24 381/182 |
| 6,647,122 | B1 | 11/2003 | Jones | |
| 8,175,321 | B2 | 5/2012 | Bryant et al. | |
| 8,660,279 | B2 | 2/2014 | Varla | |
| 8,804,996 | B2 | 8/2014 | Oclee-Brown | |
| 2007/0023229 | A1 | 2/2007 | Yang | |
| 2010/0092023 | A1 | 4/2010 | Bryant et al. | |
| 2013/0142379 | A1 | 6/2013 | Varla et al. | |

FOREIGN PATENT DOCUMENTS

| | | | |
|---|---|---|---|
| JP | 60153093 | | 8/1985 |
| JP | 09187094 | | 7/1997 |
| JP | 1013988 | | 1/1998 |
| JP | 2002034097 | | 1/2002 |
| JP | 2003259496 | A | 9/2003 |
| JP | 2011514084 | | 4/2011 |
| RU | 2454824 | A | 4/2012 |
| WO | 2008085177 | A1 | 7/2008 |
| WO | 2009109228 | A1 | 9/2009 |

OTHER PUBLICATIONS

IP Australia; Examination Report No. 1 issued in application 2018201705; dated Oct. 12, 2018; 6 pages; Australia.

Finnish Patent and Registration Office; Search Report; dated Nov. 27, 2017; 1 page; Finnish Patent and Registration Office; Helsinki, Finland.

The Federal Institute of Industrial Property; "Inquiry under the Substantive Examination"(Office action); dated Dec. 21, 2018; 2 pages (translation = 9 pages); Federal Institute of Industrial Property; Moscow, Russia.

Notification of Reason for Refusal, dated Jul. 25, 2019, Japan.

Notification of the Patentability Examination Results, dated May 20, 2019, Moscow, Russia.

* cited by examiner

DIAPHRAGM ASSEMBLY, TRANSDUCER AND METHOD OF MANUFACTURE

CROSS-REFERENCE TO RELATED APPLICATIONS

This is application claims priority of Finnish Patent Application No. 20175387 filed May 3, 2017.

FIELD

The present disclosure relates to devices sound reproduction. In particular, the disclosure relates to a diaphragm assembly for a loudspeaker transducer. More specifically, the disclosure relates to a diaphragm assembly according to the preamble portion of claim 1, to a loudspeaker transducer comprising the same and to a method for manufacturing a loudspeaker diaphragm assembly of a transducer.

BACKGROUND

In pursuit of natural and uncoloured sound reproduction loudspeakers are generally designed to produce only the frequencies intended to be reproduced. This means that it is desirable to minimize secondary emissions stemming from the construction of the loudspeaker. As loudspeaker design does involve various practical compromises, elements of the speaker may have a tendency to exhibit natural oscillation in the sound frequency range of the loudspeaker, which deteriorates the pursued flat response. Accordingly, efforts have been made to control mechanical resonances of the vibrating diaphragm. One goal of diaphragm assembly design is therefore to avoid problematic resonances, called cone break-up modes, mainly in the operating frequencies of the diaphragm assembly or above it. Break-up above the operational frequency range show as deterioration of the distortion characteristics. In an attempt to eliminate excess noises, U.S. Pat. No. 8,804,996 B2 proposes to drive a stiffened diaphragm from the node of the first mode of vibration of the diaphragm.

While very effective, special stiffening structures are quite delicate to manufacture and to assemble onto a voice coil. It would, therefore, be desirable to provide a diaphragm assembly with good control over the mechanical resonances that would also be susceptible to automated manufacturing.

SUMMARY

The novel diaphragm assembly includes a diaphragm having a first diaphragm component and a second diaphragm component. Both diaphragm components extend between respective inner perimeter and outer rim. The outer rim of the first diaphragm component overlaps with and is attached to the second diaphragm component at an overlap section. A voice coil assembly is connected to the inner perimeter of the second diaphragm component.

On the other hand a novel transducer is proposed employing such a diaphragm assembly.

In addition, a corresponding manufacturing method is proposed including the steps of:

inserting a voice coil gauge inside a voice coil former, inserting the voice coil with the gauge to an air gap, attaching the voice coil to the inner perimeter of a second diaphragm component, removing the voice coil gauge, and attaching a first diaphragm component to the second diaphragm component at an overlap section.

The invention is defined by the features of the independent claims. Some specific embodiments are defined in the dependent claims.

Considerable benefits are gained with aid of the novel concept. Compared to conventional unstiffened diaphragms, which are easy to manufacture, the overlapping contact point between the diaphragm components provides a stiff mounting site for the voice coil assembly that resides distanced from the inner perimeter of the diaphragm, i.e. from the inner perimeter of the first diaphragm component. The increased distance moves the resonances of the diaphragm to higher, less problematic frequencies and thereby improves control over the break-up modes of the diaphragm assembly. In addition, the added effective radiation surface provided by the first diaphragm component to that provided by the second diaphragm component increases the volume displacement of the diaphragm assembly.

On the other hand, compared to advanced diaphragm designs employing stiffening elements, such as ribbing, the diaphragm assembly is more suitable for automated manufacturing. Whereas ribbing or similar reinforcement elements are difficult to precisely position onto the diaphragm, the voice coil assembly may be positioned in respect to the inner perimeter of the second diaphragm component by using a voice coil gauge which assumes correct position on the inner perimeter of the second diaphragm component and receives and allows a sliding guide for the voice coil former to align with the inner perimeter of the second diaphragm component. Such gauge will not only help radial the radial alignment of the voice coil in respect to the inner perimeter of the second diaphragm component but also with the axial alignment. While the fit could be performed with a particular adapter that would add weight to the diaphragm. Accordingly, the manufacturing method is very robust.

BRIEF DESCRIPTION OF THE DRAWINGS

In the following exemplary embodiments are described in greater detail with reference to the accompanying drawings in which.

EMBODIMENTS

In the following paragraphs it will become apparent that by connecting a voice coils assembly to the inner perimeter of a second diaphragm component which in turn is connected over an overlapping portion to the outer rim a first diaphragm component will facilitate the manufacture of a diaphragm assembly having control over the break-up modes of the diaphragm assembly. Firstly, however, the terminology used will be clarified in an explanatory, non-limiting fashion.

In the present context the term "diaphragm" refers to a loudspeaker diaphragm or membrane that is constructed by virtue of material, construction, or both to convert reciprocal movement of a voice coil into increased volume velocity of air. In other words, the term "diaphragm" refers to the general meaning of diaphragm that is established in the field of loudspeaker construction. This is to distinguish from arbitrary flexible elements unable to produce sound without significant buckling or distortion. For example, thin and sheet-like suspension elements for suspending the diaphragm to the frame of a transducer would not qualify as a diaphragm in the present context despite exhibiting a vaguely similar appearance in a cross-sectional illustration.

In the present context the term "outer rim" refers to the general outer periphery of a diaphragm or diaphragm component covering not only the terminal surface or edge of the diaphragm or diaphragm component but also a radial zone of the diaphragm or diaphragm component towards the acoustic axis of the diaphragm assembly.

In the present context the term "inner perimeter" refers to the general inner periphery of a diaphragm or diaphragm component covering not only the terminal surface or edge of the diaphragm or diaphragm component but also a radial zone of the diaphragm or diaphragm component towards the outer rim of the diaphragm assembly.

Figure 1:
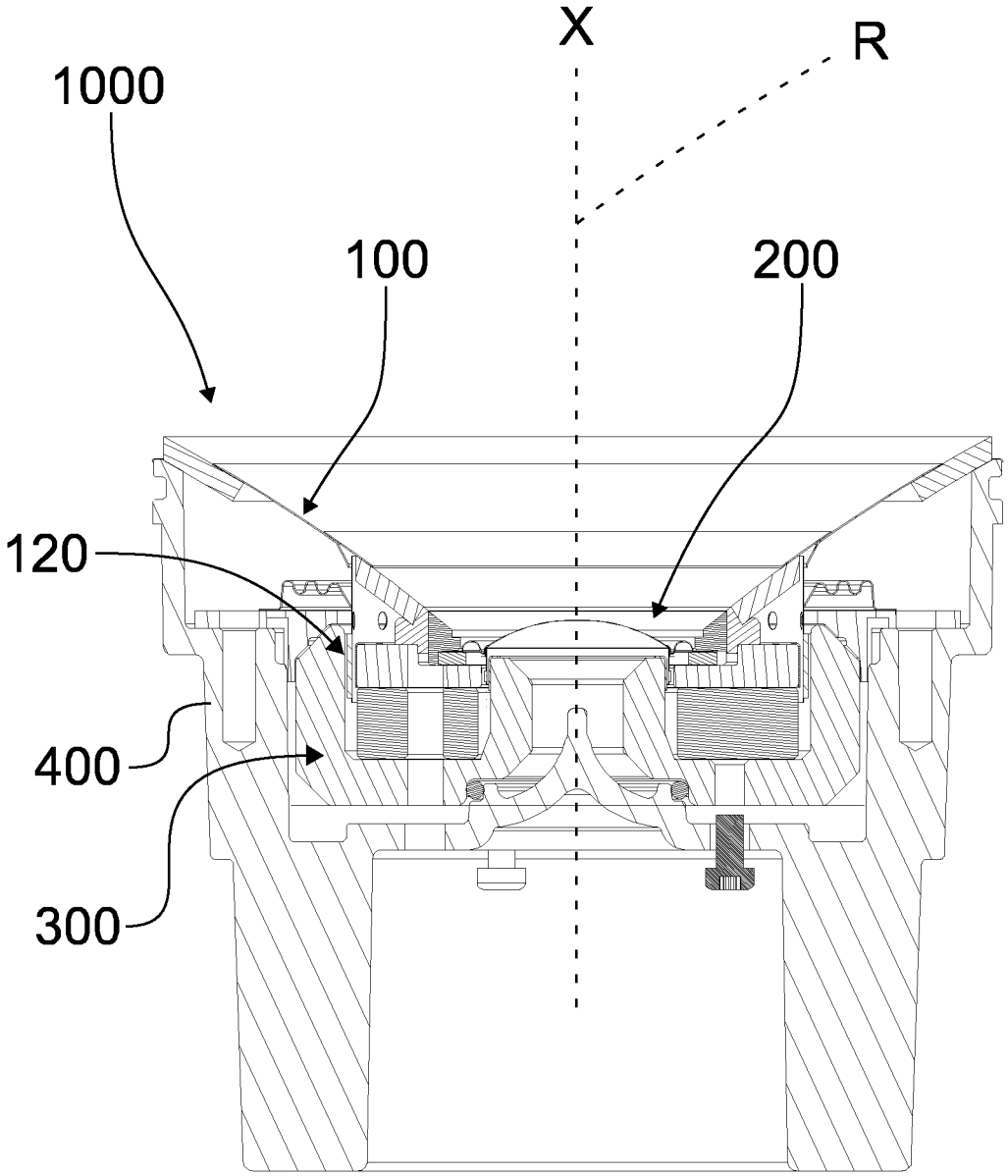
FIG. 1 illustrates a cross-sectional view of a transducer in accordance with at least some embodiments of the present invention.

Turning first to FIG. 1 which shows a loudspeaker transducer 1000 isolated from an enclosing loudspeaker enclosure (not shown). The transducer 1000 includes a frame 400 that acts as rigid reference for the moving parts of the transducer as well as houses a magnetic circuit 300 and at least one diaphragm assembly. The present example illustrates a transducer 1000 hosting two diaphragm assemblies, namely a lower frequency diaphragm assembly 100 for producing a mid- and/or low-frequency band and a higher frequency diaphragm assembly 200 for producing a high frequency band. The diaphragm assembly 100 is constructed as a sub-assembly of the loudspeaker transducer 1000. Such diaphragm assemblies 100, 200 are generally referred to as a mid-range transducer and a tweeter, respectively. The lower frequency diaphragm assembly 100 is a cone diaphragm assembly in the general sense of loudspeaker construction. The higher diaphragm assembly 200 may be a dome diaphragm assembly in the general sense of loudspeaker construction as shown or e.g. another smaller conical diaphragm assembly (not shown). Instead of the illustrated multi-way transducer, the transducer 100 could alternatively be constructed as one-way transducer featuring a solitary diaphragm assembly 100.

In the illustrated example the diaphragm assemblies 100, 200 share an acoustic axis X. Alternatively, the diaphragm assemblies 100, 200 could be offset so as to include two distinct acoustic axes that could be parallel or tilted in respect to one another. The coaxial construction is, however, beneficial for the sake of directivity. The orientation of the acoustic axis X of the diaphragm assembly 100, 200 or, in the case of a coaxial unit, the entire transducer 1000 is defined by the direction of motion experienced by the diaphragm of the diaphragm assembly. This direction is in turn defined by the dimension of reciprocal motion experienced by the voice coil assembly 120 driving the diaphragm of the diaphragm assembly. The acoustic axis X should be understood to refer to the intended main primary direction of sound propagation of the transducer and/or the pursued axis of symmetry of the produced sound pattern. The acoustic axis X could alternatively be understood as an axis on which the sum of the sound output of the transducer is most ideal. Typically the acoustic axis is the designed listening axis of the loudspeaker. The acoustic axis X may be, but need not be, the axis of symmetry of the diaphragm assembly 100.

Figure 2:
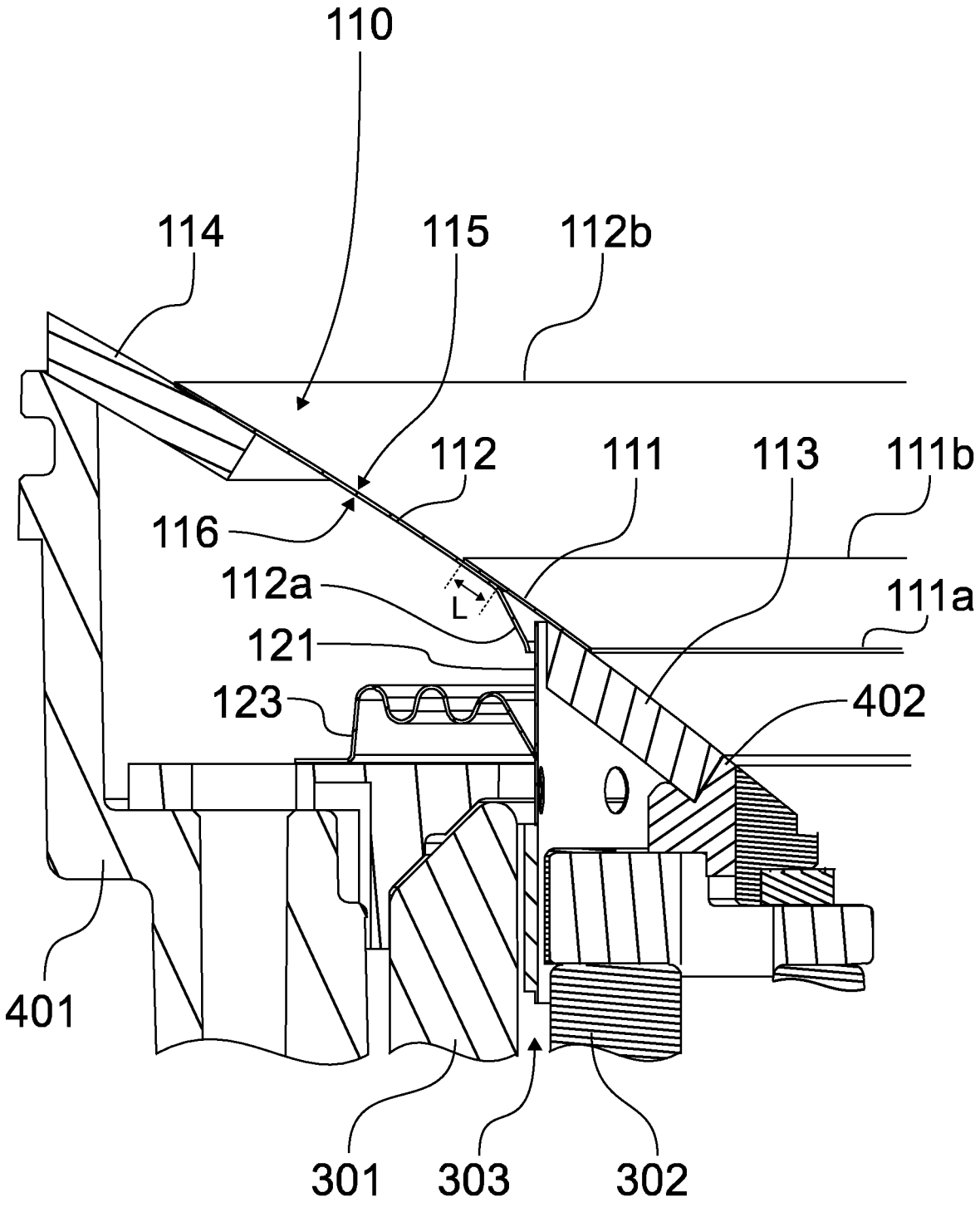
FIG. 2 illustrates a simplified detail view of the transducer of FIG. 1.

Turning now to FIG. 2 which shows a detailed view of the lower frequency diaphragm assembly 100. As may be seen, the diaphragm assembly 100 is attached to the frame between an outer frame section 401 and an inner frame section 402. The outer frame section 401 will attach the transducer 1000 to an enclosing enclosure, such as a loudspeaker cabinet or a wall in a flush installation setup or another receiving structure. The inner frame section 402 may house the optional higher frequency diaphragm assembly 200. The magnetic circuit 300 is attached to the frame 400 between the outer and inner sections 401, 402. The magnetic circuit 300 includes a magnet 301 and a surrounding center pole 301 with an annular gap 303 there between.

The diaphragm assembly 100 is suspended to the outer frame section 401 by means of an outer suspension element 114. The outer suspension element 114 surrounds the diaphragm 110 and connects it to the frame 400 of the transducer 1000 in a flexible manner so as to allow the diaphragm 110 to experience axial reciprocal translation, i.e. forth to back movement in a direction parallel to the acoustic axis X. In other words, the outer suspension element 114 is a flexible structure allowing the diaphragm 100 to move repeatedly in the primary acoustical direction of the transducer 1000 and to return to the rest position after being deviated by the voice coil in the primary acoustical direction. The outer suspension element 114 may be constructed as an annular member. Suitable materials include rubbers, foam plastics or Styrofoam, fabrics, particularly conditioned fabrics, thermoplastic elastomers, urethanes, and silicones. The outer suspension element 114 may be constructed from the same material as the primary vibrating diaphragm 110 but relieved or otherwise constructionally altered so as to provide elasticity to allow for the translation of the diaphragm 110. Regardless of the construction and material of the outer suspension element 114 its task is to allow the intended travel of the diaphragm 110. Accordingly, it is beneficial that the outer suspension element 114 is constructed to allow the axial translation of the diaphragm 110, to support the diaphragm 110 in the radial dimension so as to prevent tilt, to seal the inner side of the diaphragm 110 from the outer side so as to prevent an acoustic short circuit, and/or to provide a returning force for returning the diaphragm to the position of rest of the diaphragm 110.

The diaphragm 110 exhibits a frusto-conical shape as understood in the field. As shown in FIG. 2, which represents a cross-section is taken along the acoustic axis X, the sectional shape of the diaphragm 110 that extends away from the acoustic axis X over a contour which comprises a component in the direction of the acoustic axis X as well as in a direction transversal to the acoustic axis X. In other words, the diaphragm 110 is an annular disc extending in the radial dimension R when viewed in a cross-sectional plane taken along the acoustic axis X of the diaphragm assembly 100. In the present context the term "radial" refers to a dimension or contour extending from the acoustic axis X of a diaphragm assembly along a straight or curved path in any angle excluding 0 and 180 angles in respect to the acoustic axis X. The radial dimension R is therefore defined by a path formed by successive points of a diaphragm 110 extending away from the acoustic axis X towards the outer rim of the diaphragm 100 when viewed in a cross-section taken along the acoustic axis X. Accordingly it may be seen that because the imaginary extensions of the cross-sectional shape of the diaphragm converge on the acoustic axis X of the diaphragm assembly, e.g. at the same point on the acoustic axis X, the flaring shape of the diaphragm 110 may be said to be radial.

The diaphragm 110 has a double-component structure including a first diaphragm component 111 and a second diaphragm component 112. The two diaphragm components 111, 112 are arranged in a nested configuration in respect to each other. In other words the diaphragm components 111, 112 are superposed so as to create an overlap section L in the radial dimension R. The overlap section L may extend over the entire length of either diaphragm component 111, 112 or—as shown in the FIGURES—the diaphragm components

111, 112 may be radially displaced so that the overlap section L only covers a radial portion of the diaphragm components 111, 112. The first diaphragm component 111 lies closer to the acoustic axis X and is to be considered as the inner diaphragm component 112. The first diaphragm component 111 extends in the radial dimension R between an inner perimeter 111*a* and an outer rim 111*b*. The second diaphragm component 112 lies farther from the acoustic axis X and is to be considered as the outer diaphragm component. The second diaphragm component extends in the radial dimension R between an inner perimeter 112*a* and an outer rim 112*b*. As seen in FIG. 2, the inner perimeter 112 of the second diaphragm component 112 includes a neck, i.e. a section extending in a steep angle towards the magnetic circuit 300 of the transducer 1000 in respect to the remaining portion of the second diaphragm component 112. The inner perimeter 111*a* of the first diaphragm component 111 may or may not include a neck. In the illustrated example, the inner perimeter 111*a* of the first diaphragm 111 is straight and does not include a neck.

The overlap section L is formed by the overlapping respective radial sections of the outer perimeter 111*b* of the first diaphragm component 111 and a section of the second diaphragm component 112. The section of the second diaphragm component 112 participating in the formation of the overlap section L may reside anywhere along the radial dimension R, but in the illustrated example the overlapping section resides adjacent to the inner perimeter 112*a* of the second diaphragm component 112. The overlap section L may extend over 1 to 100% of the radial extension R of the second diaphragm component 112. It is, however, beneficial that overlap is in the range of 5 to 20% of the radial extension R of the second diaphragm component 112. The two diaphragm components 111, 112 are attached to each other at the overlap section L. The contact may be point-like, annular seam or contact over the entire area covered by the overlap section L. The connection may be made by gluing, welding or other similar means of fixing. In the illustrated example the overlap section L is annular, specifically circular, due to the rotationally symmetrical character of the diaphragm components 111, 112. However, the overlap section L may also be shaped to include radially alternating shapes when viewed along its perimeter about the acoustic axis X. More specifically, the overlap section L or at least the outer portion of the overlap section L may exhibit a zig-zag or smoothly radially fluctuating shape so as to disperse diffraction caused by a discontinuity in the seam between the diaphragm components 111, 112.

As mentioned above, the diaphragm 110 exhibits a generally frusto-conical shape. The diaphragm components 111, 112 are therefore shaped to formulate such shape. In the present context the term "conical" refers not only to mathematical cones but is to be understood so as to also refer to cones as understood in the field of loudspeaker construction. Accordingly the expression also includes curved diaphragms and rotationally non-symmetrical diaphragms and frusto-conical versions of the same. Accordingly, the first diaphragm component 111 and the second diaphragm component (112) are tangentially aligned for creating a continuous outer surface for the diaphragm (110). In the present context the term "continuous" refers not only to mathematical continuity but is to be understood so as to refer to a surface meant in the field of loudspeaker construction to including surfaces exhibiting small axial deviations that bear little, i.e. non-measurable, or no significance to the output of the diaphragm assembly or transducer. This is to say that the flare to the same direction. Generally speaking and within reasonable manufacturing tolerances, the diaphragm components 111, 112 are parallel. The above applies particularly at the overlap section L where the diaphragm components 111, 112 are attached to each other. Outside the overlap section L it is of course possible that there is slight deviation in the tangential alignment of the respective shapes. For example, FIG. 2 shows a small ridge between the first and second diaphragm component 111, 112 at the outer edge of the overlap section L. Such a small ridge would in theory create a tangential misalignment but it is to be disregarded for being minute, i.e. for not creating measurable significance to the sound output.

The diaphragm has an outer side 115 for sound propagation along the acoustic axis X of the diaphragm assembly 100 and an inner side 116 opposing the outer side 115. The voice coil assembly 120 is attached to the inner side 116 of the diaphragm assembly 100. More particularly, the voice coil former 121 of the voice coil assembly 120 is attached to the inner perimeter 112*a* of the second diaphragm component 112. As mentioned above, the inner perimeter 112*a* has a neck for facilitating easy connection to the voice coil former 121. The inner perimeter 112*a* of the second diaphragm component 112 is also at the region participating in the formation of the overlap section L. Accordingly, it may be seen that the inner perimeter 112*a* of the second diaphragm component 112 has a seam portion extending parallel to the first diaphragm component 112 over the overlap section L and a neck portion extending from the seam portion in a steep angle towards the magnetic circuit 300 of the transducer 1000. The force exerted by the voice coil to the composite diaphragm 110 thus acts on a very stiff point in the diaphragm 110 because the voice coil attaches to the joint between the inner and outer diaphragm components, namely to the first and second diaphragm component 111, 112. This can reduce the tendency for cone break-up resonances. FIG. 2 also reveals how the first diaphragm component 111 covers—particularly extends over—the point of contact between the second diaphragm component 112 and the voice coil assembly 120 when viewed from the outer side along the acoustic axis X. This overreaching section provided by the first diaphragm component 111 increases the radiating surface of the diaphragm assembly 100 compared to traditional diaphragm assemblies.

The voice coil assembly 120 is also suspended to the transducer frame 400 and aligned to the magnetic air gap 303 by means of a spider 123.

As established above, the diaphragm 110 is suspended to the frame at the outer perimeter of the second diaphragm component 112 by the outer suspension element 114. If the transducer is constructed as a one-way transducer (not shown), the center opening of the transducer may be covered by a dust cap or provided with a plug (not shown). If the transducer is constructed as a multiway transducer as shown in the FIGURES, the diaphragm 110 is suspended to the inner frame section 402 of the transducer frame 400 also housing a higher frequency diaphragm assembly 200. The first diaphragm component 111 may therefore be suspended to the loudspeaker frame 400 with an inner suspension element 113. The inner suspension element 113 may be similar to the outer suspension element 114 or tweaked to provide particular suspension characteristics. While the suspension elements 113, 114 and the diaphragm components 111, 112 both exhibit a sheet-like construction, the purpose and mechanical characters are radically different to each other. The diaphragm 110 is constructed rigid enough for sound reproduction whereas the suspension elements 113, 114 are constructed to be elastic enough to allow for axial displacement of the rigid diaphragm 110 during sound reproduction. The diaphragm components may be made of rigid materials such as aluminum, paper or polypropylene. The diaphragm components may be made from the same or different materials in respect to one another. The suspension elements, on the other hand, may be made of elastic materials, such as those listed above. Accordingly, the first diaphragm component 111 or the second diaphragm component 112 or both has/have an axial rigidity or combined axial rigidity that is larger than the axial rigidity of the at least one suspension element 113, 114. More specifically, the axial rigidity of the first diaphragm component 111 or the second diaphragm component 111 or both is of different order of magnitude compared to the axial rigidity of the at least one suspension element 113, 114. In the present context the term "axial rigidity" refers to the ability of a component, such as a diaphragm component or diaphragm, to withstand deformation when stressed in a direction parallel to the acoustic axis of the diaphragm assembly. Axial rigidity may be measured as force required for deformation of a unit of length at a given point, e.g. mid point of the span length of the component. Due to the difference in rigidity, the axial travel of the outer suspension element 114 or the inner suspension element 113 or both is at most half that of the diaphragm 110 observed at mid-point along the radial R extension of the outer suspension 114 and diaphragm 110, respectively. To further facilitate directivity of the transducer, the suspension elements 113, 114 are preferably tangentially aligned with the diaphragm 110.

In the illustrated embodiment, the inner perimeter 111*a* of the first diaphragm component 111, particularly the inner surface thereof, is attached to the inner suspension element 113, particularly to the outer surface thereof. Similarly the outer perimeter 112*b* of the second diaphragm component 112, particularly the inner surface thereof, is attached to the outer suspension element 114, particularly to the outer surface thereof. There are, however, alternatives to this construction. The connecting surfaces could, for example, be reversed in the outer surfaces of the diaphragm components could contact the inner surface of the suspension elements (not shown). A variation of the latter embodiment would be such where the suspension elements would be joined or made integral so that the suspension element would cover the diaphragm, which would be attached to the inner surface of the suspension element. This embodiment has the added benefit of creating a "seamless" waveguide for the higher frequency diaphragm assembly 200. If the suspension element is made to cover the diaphragm, it may be advantageous to manufacture the suspension element from two or more components to facilitate manufacturing. In particular, the suspension components would first be attached to respective diaphragm components and then joined to each other on the outer surface of the diaphragm upon assembly of the diaphragm components to each other.

Despite not being illustrated in the drawings, it is also possible to add more components to the diaphragm to tweak the properties of the diaphragm.

Regardless of the suspension element construction employed, the novel design of the two-component diaphragm of the diaphragm assembly provides for easy manufacturing while achieving great volume displacement. The manufacturing benefit arises from attaching the voice coil assembly to the inner perimeter, particularly to the neck, of the second diaphragm assembly thus enabling the use of a suitably large voice coil without compromising the modal characteristics of the diaphragm assembly or the radiating surface area. In the following is an exemplary and sequentially variable step-by-step description of production steps of a diaphragm assembly described with reference to FIG. 2:

A voice coil gauge is inserted inside the voice coil former 121.

The voice coil with the gauge is inserted to the air gap 303. The gauge defines the height and radial placement of the voice coil in the air gap 303.

Adhesive is applied on the frame 401, i.e. the basket, for the outer perimeter of the spider 123 or to the respective portion of the spider 123.

The spider 123 is placed on the voice coil former 121.

The sub-assembly formed by the voice coil and spider 123 is pressed down against the magnet system, whereby the gauge stop level defines the correct height for the voice coil.

Adhesive is applied the contact point between the spider 123 and voice coil former 121.

A sub-assembly comprising the second diaphragm component 112 and the outer suspension element 114 is prepared by applying adhesive to the contact point between the second diaphragm component 112 and the outer suspension element 114 and brining the two into contact.

Adhesive is applied on to the contact surface of the outer frame section 401 for receiving the outer suspension element 114 or to the respective contact surface of the outer suspension element 114.

The sub-assembly formed by the second diaphragm component 112 and the outer suspension element 114 is placed onto the frame 400.

Adhesive is applied to the contact point between the second diaphragm component 112 and the voice coil former 121.

The second diaphragm component 112 is attached to the voice coil former 121.

The voice coil gauge is removed.

A sub-assembly comprising the first diaphragm component 111 and the inner suspension element 113 is prepared by applying adhesive to the contact point between the first diaphragm component 111 and the inner suspension element 113 and brining the two into contact.

Adhesive is applied to the overlap section L on either or both contact surfaces of the first and second diaphragm components 111, 112.

Adhesive is applied to the respective contact surface or contact surfaces between the inner frame section 402 of the frame 400 and the inner suspension element 113.

The sub-assembly comprising the first diaphragm component 111 and the inner suspension element 113 is placed onto the sub-assembly formed by the second diaphragm component 112 and the outer suspension element 114 and onto the frame 402.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

The invention claimed is:

1. A diaphragm assembly comprising:

a diaphragm having:

a first diaphragm component extending between an inner perimeter and an outer rim, the outer rim including a terminal outer edge of the first diaphragm component, and a second diaphragm component extending between an inner perimeter and an outer rim, wherein the terminal outer edge of the outer rim of the first diaphragm component overlaps the second diaphragm component and wherein the second diaphragm component is attached to the first diaphragm component at an overlap section, and a voice coil assembly connected to the inner perimeter of the second diaphragm component of the diaphragm.

2. The diaphragm assembly according to claim 1, wherein the overlap section is annular.

3. The diaphragm assembly according to claim 1 wherein the diaphragm has a cross-sectional shape that extends away from the acoustic axis of the diaphragm assembly over a contour which comprises a component in the direction of the acoustic axis, when the cross-section is taken along the acoustic axis.

4. The diaphragm assembly according to claim 1, wherein the diaphragm is frusto-conical.

5. The diaphragm assembly according to claim 1, wherein first and second diaphragm components are annular.

6. The diaphragm assembly according to claim 1, wherein the overlap section extends over 5 to 20% of the radial extension of the second diaphragm component in a radial direction in respect to the acoustic axis of the diaphragm assembly.

7. The diaphragm assembly according to claim 1, wherein the first diaphragm component and the second diaphragm component are tangentially aligned.

8. The diaphragm assembly according to claim 1, wherein the first diaphragm component covers a connection between the second diaphragm component and the voice coil assembly when viewed from the outer side along the acoustic axis of the diaphragm assembly.

9. The diaphragm assembly according to claim 1, wherein the diaphragm is constructed rigid enough for sound reproduction.

10. The diaphragm assembly according to claim 1, wherein the diaphragm assembly is constructed as a sub-assembly of a loudspeaker transducer.

11. A loudspeaker transducer comprising a diaphragm assembly which comprises:

a diaphragm having:

a first diaphragm component extending between an inner perimeter and an outer rim, the outer rim including a terminal outer edge of the first diaphragm component, and a second diaphragm component extending between an inner perimeter and an outer rim, wherein the terminal outer edge of the outer rim of the first diaphragm component overlaps the second diaphragm component and wherein the second diaphragm component is attached to the first diaphragm component at an overlap section, and a voice coil assembly connected to the inner perimeter of the second diaphragm component of the diaphragm.

12. The loudspeaker transducer according to claim 11, wherein the loudspeaker transducer comprises:

a frame, and at least one suspension element which is configured to suspend the diaphragm to the frame of the loudspeaker transducer.

13. The loudspeaker transducer according to claim 12, wherein:

the first diaphragm component or the second diaphragm component or both the first diaphragm component and the second diaphragm component has/have an axial rigidity or combined axial rigidity that is larger than the axial rigidity of the at least one suspension element.

14. The loudspeaker transducer according to claim 12 wherein an axial rigidity of:

the first diaphragm component or the second diaphragm component or both the first diaphragm component and the second diaphragm component is of different order of magnitude compared to the axial rigidity of the at least one suspension element.

15. The loudspeaker transducer according to claim 12, wherein the axial travel of the at least one suspension element is at most half that of the diaphragm at the mid-point along the radial extension of the outer suspension and diaphragm, respectively.

16. The loudspeaker transducer according to claim 12, wherein the at least one suspension element and the diaphragm are tangentially aligned.

17. The loudspeaker transducer according to claim 12, wherein the at least one suspension element is an outer suspension element connected to the outer rim of the second diaphragm component for suspending the diaphragm assembly to a surrounding frame of the loudspeaker transducer.

18. The loudspeaker transducer according to claim 12, wherein the at least one suspension element is an inner suspension element connected to the inner perimeter of the first diaphragm component for suspending the diaphragm assembly to a center frame element of the loudspeaker transducer.

19. The loudspeaker transducer according to claim 18, wherein the loudspeaker transducer is a compound transducer comprising:

the diaphragm assembly as a lower frequency diaphragm assembly and a higher frequency diaphragm assembly housed in the center frame element of the loudspeaker transducer.

20. The loudspeaker transducer according to claim 11, wherein the first break-up mode frequency of the diaphragm is at the highest frequency of the pass band of the transducer or higher.

21. A method for manufacturing the loudspeaker diaphragm assembly of a transducer, the method comprising:

inserting a voice coil gauge inside a voice coil former defining a radial axis of a voice coil, inserting the voice coil with the gauge to an air gap, attaching the voice coil to the inner perimeter of a second diaphragm component, removing the voice coil gauge, and attaching a first diaphragm component to the second diaphragm component at an overlap section, such that the outer perimeter of the second diaphragm component extends further from the radial axis than the outer perimeter of the first diaphragm component.

22. The method according to claim 21, wherein the transducer comprises a diaphragm assembly which comprises:

a diaphragm comprising:

a first diaphragm component extending between an inner perimeter and an outer rim, and a second diaphragm component extending between an inner perimeter and an outer rim, wherein the outer rim of the first diaphragm component overlaps the second diaphragm component over an overlap section and wherein the second diaphragm component is attached to the first diaphragm component at the overlap section, and a voice coil assembly connected to the inner perimeter of the second diaphragm component of the diaphragm.

23. The method according to claim 21 wherein the attaching method is gluing.

* * * * *